US009879451B2

(12) United States Patent
Muller et al.

(10) Patent No.: US 9,879,451 B2
(45) Date of Patent: Jan. 30, 2018

(54) HANDLE DEVICE HAVING A MECHANICAL RETURN MECHANISM

(75) Inventors: Dirk Muller, Essen (DE); Mario Christensen, Mulheim (DE); Stefan Monig, Schwelm (DE); Cristof Brauner, Essen (DE); Martin Witte, Ahaus (DE); Norbert Heller, Viersen (DE)

(73) Assignee: HUF HULSBECK & FURST GMBH & CO., Velbert (DE)

( * ) Notice: Subject to any disclaimer, the term of this patent is extended or adjusted under 35 U.S.C. 154(b) by 1137 days.

(21) Appl. No.: 13/502,803

(22) PCT Filed: Sep. 18, 2010

(86) PCT No.: PCT/DE2010/001109
§ 371 (c)(1),
(2), (4) Date: Apr. 19, 2012

(87) PCT Pub. No.: WO2011/047649
PCT Pub. Date: Apr. 28, 2011

(65) Prior Publication Data

US 2012/0228886 A1 Sep. 13, 2012

(30) Foreign Application Priority Data

Oct. 20, 2009 (DE) ..... 10 2009 045 875

(51) Int. Cl.
*E21B 33/10* (2006.01)
*E05B 85/10* (2014.01)
(Continued)

(52) U.S. Cl.
CPC ..... *E05B 85/107* (2013.01); *E05B 17/10* (2013.01); *E05B 81/76* (2013.01); *E05B 85/103* (2013.01); *Y10T 292/57* (2015.04)

(58) Field of Classification Search
CPC ..... E05B 63/0056; E05B 85/16; E05B 85/00; E05B 85/107; E05B 17/10; E05B 81/176; E05B 85/103; Y10T 292/57
(Continued)

(56) References Cited

U.S. PATENT DOCUMENTS 3,153,553 A * 10/1964 Sandor ..... 292/336.3
3,528,695 A * 9/1970 Peters ..... 292/336.3
(Continued)

FOREIGN PATENT DOCUMENTS

DE 40 02 963 C1 7/1991
DE 197 31 325 A1 1/1999
(Continued)

OTHER PUBLICATIONS

International Search Report dated Feb. 1, 2011, in connection with PCT/DE2010/001109.

*Primary Examiner* — Nathan Cumar
(74) *Attorney, Agent, or Firm* — Quarles & Brady LLP

(57) ABSTRACT

The invention relates to a handle device (10) for a lock unit (12) for a movable door (11) or the like on a vehicle, comprising a handle part (51) which is movably mounted relative to a door (11) of the vehicle and which can be displaced between a rest position (Ia) and an operating position (Ib,c), the handle part (51) being flush with the exterior of the door (11.5) in the rest position (IA) and projecting from the exterior of the door (11.5) in the operating position (Ib,c). The handle part (51) can be actuated to open the door (10) when in the operating position (Ib,c). An actuating unit (33) is used to transfer the handle part (51) at least from the rest position (Ia) to a first operating position (IB). According to the invention, the actuating unit (33) is pivotably mounted.

9 Claims, 6 Drawing Sheets

Figure 1:
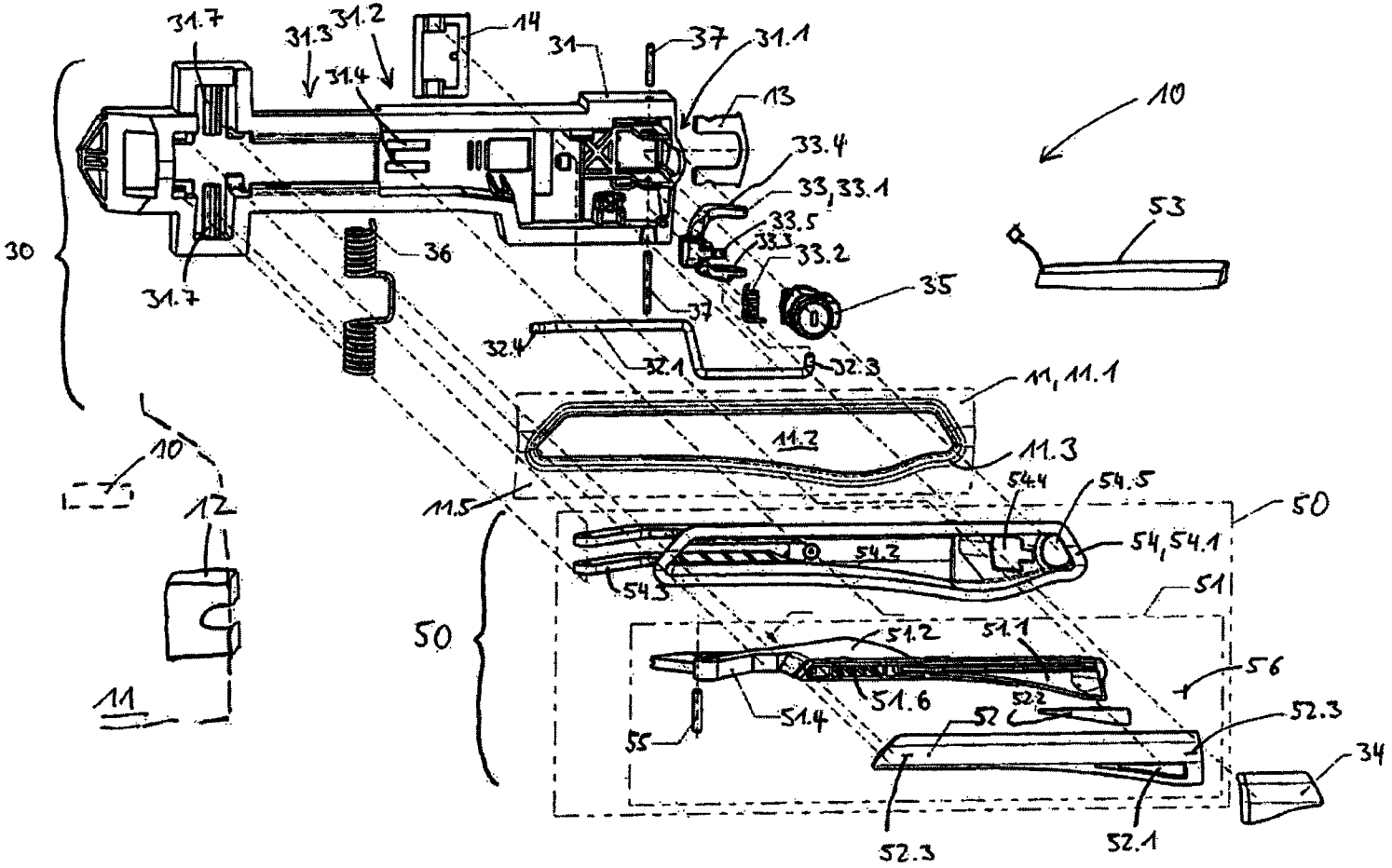

(51) Int. Cl.
*E05B 81/76* (2014.01)
*E05B 17/10* (2006.01)

(58) Field of Classification Search
USPC ..... 292/1, 336.3, 201, 216, DIG. 23, 292/DIG. 31, DIG. 65; 16/110.1, 412, 16/413, 415, 416
See application file for complete search history.

(56) References Cited

U.S. PATENT DOCUMENTS

| | | | | |
|---|---|---|---|---|
| 3,544,148 | A * | 12/1970 | Sandor | 292/336.3 |
| 3,554,148 | A | 1/1971 | Sandor | |
| 5,496,078 | A * | 3/1996 | Yasuda | 292/165 |
| 6,158,788 | A | 12/2000 | Ikeda et al. | |
| 6,606,889 | B1 * | 8/2003 | Tweedy | 70/208 |
| 7,013,689 | B2 * | 3/2006 | Graham et al. | 70/208 |
| 7,526,936 | B2 * | 5/2009 | Niskanen et al. | 70/423 |
| 7,543,863 | B2 * | 6/2009 | Herbert et al. | 292/336.3 |
| 8,544,904 | B2 * | 10/2013 | Kindig | 292/336.3 |
| 2007/0069531 | A1 * | 3/2007 | Herbert et al. | 292/336.3 |
| 2008/0190157 | A1 * | 8/2008 | Mizuno | 70/455 |

FOREIGN PATENT DOCUMENTS

| | | | | |
|---|---|---|---|---|
| DE | 19731325 | A1 * | 1/1999 | E05B 65/26 |
| DE | 102 19 634 | A1 | 11/2003 | |
| DE | 103 09 821 | A1 | 9/2004 | |
| DE | 102004036663 | A1 | 3/2006 | |
| DE | 10 2008 028 391 | A1 | 12/2009 | |
| EP | 0 822 306 | A2 | 2/1998 | |
| EP | 1 607 555 | A2 | 12/2005 | |
| EP | 1 985 784 | A1 | 10/2008 | |
| FR | 979 715 | A | 5/1951 | |
| FR | 1 035 341 | A | 8/1953 | |
| GB | 632123 | A | 11/1949 | |

* cited by examiner

HANDLE DEVICE HAVING A MECHANICAL RETURN MECHANISM

CROSS-REFERENCE TO RELATED APPLICATIONS

This application claims priority to PCT International Application No. PCT/DE2010/001109 filed on Sep. 18, 2010, which claims priority to German Patent Application No. 10 2009 045 875.1 filed on Oct. 20, 2009, both of which are fully incorporated by reference herein.

The present invention is directed toward a handle device for a locking device for a movable door or the like on a vehicle according to the preamble of claim 1. In this case, the handle device has a handle part which is mounted movably with respect to a door of the vehicle and is movable between a rest position and an operating position. In the rest position, the handle part is arranged flush with the outer side of the door and, in the operating position, said handle part protrudes from the outer side of the door in the manner of a projection, wherein, in the operating position, the handle part can be operated in order to open the door. Furthermore, in this handle device, an actuating unit is provided, by means of which the handle part can be transferred at least from the rest position into a first operating position.

A generic prior art is disclosed, for example, in DE 10 2004 036 663 A1. In this case, the comparable handle part is spring-loaded in the rest position and is locked in the rest position via a button. Upon actuation of the button, the latter releases the spring-loaded handle part, the spring force transferring the handle part from the rest position into the operating position. From this position, the handle part can be transferred into an end position or second operating position in order to actuate a locking device. However, handle devices of this type have the disadvantage that the movably mounted handle part has to be transferred from an operating position back into the rest position. This can only take place by further manual actuation or by an electromechanical drive. However, the convenience of a handle device of this type is significantly reduced by this. There is also the risk during a manual return of the handle that the handle part has not been transferred from the operating position thereof into the rest position, and then said handle part protrudes from the outer side of the door in an interfering manner. However, this means that the advantages of a flush handle device are lost.

It is therefore the object of the present invention to provide a handle device which has simple operation and a high level of security. In order to achieve the abovementioned object, a handle device with the features of the main claim, in particular with the features from the characterizing part, is proposed. Further advantageous refinements of the invention emerge from the dependent claims.

According to the invention, in the handle device, the actuating unit is mounted pivotably in order to transfer the handle part from the rest position thereof into a first operating position. It is thus optionally provided for the actuating unit to be provided with an actuating element which interacts mechanically with the handle part and, upon actuation, transfers the handle part into the operating position. In this connection, the handle part is spring-loaded in such a manner that the handle part is always pressed into the rest position thereof, the actuating element, in particular, acting counter to the spring force.

Within the context of the present application, the term: door is used for a movable flap, movable cover or the like.

The handle device according to the invention has a first and a second module in order to install said handle device more easily on the door of the vehicle. The first module contains a handle mount with which said module is arranged on an inner side of the door. The second module contains a handle shell and is arranged on the outer side of the door. In this case, the handle part is additionally mounted movably on the handle shell. The handle part is installed at the same time as the handle shell is installed on the vehicle. The handle device according to the invention therefore has the advantage that even necessary installation steps of the handle device can be carried out during the manufacturing of the handle device, i.e. at the manufacturer of the handle device, rather than at the vehicle manufacturer. By this means, the final installation can be significantly simplified and the associated costs reduced. The preassembly can also be at least partially automated, whereas, by contrast, the final installation of the handle device on the door of a vehicle still requires human activity.

Furthermore, in the case of the handle device according to the invention, provision can be made for the first module to be mechanically connected to the second module in such a manner that the handle device is held on the door. It is therefore possible to arrange the handle device in a positionally fixed manner on the door only by the connection of the two modules. For this purpose, latching elements, which interact with mating latching elements on the first module in a form-fitting and/or frictional manner, can be provided on the second module. Said latching elements can be expediently configured as clips or plug-in connectors or the like which interact with corresponding mating latching elements, for example in the form of projections or recesses or the like. It is also conceivable for the two modules to be connected to each other via at least one additional fastening element. Said fastening element may consist, for example, of a screw, a rivet or a bolt or a securing plate. It has proven particularly advantageous to connect the second module to the first module via a securing plate which is pushed onto the handle mount on the inner side of the door and interacts in a form-fitting manner with the latching elements, which are configured as projections, of the second module. The use of a securing plate of this type has the advantage that it is possible for the final installation of the handle device on the door to be carried out more or less without any tools. Furthermore, shaking or other mechanical influences are also unable to release the connection between the two modules.

The handle device according to the invention is installed, as a rule, only through an aperture or an opening in the door. Owing to the large aperture, it is particularly simple to arrange the first module on the inner side and the second module on the outer side and to connect said modules to each other. For preadjustment to be achieved even at this point, the aperture can have adjusting means which are arranged, for example, as recesses or projections in the edge of the aperture. Said adjusting means interact in a form-fitting manner with mating adjusting means on the handle device. Said adjusting means therefore permit only a single predefined arrangement of the handle device in the region of the aperture of the door. Such an adjusting means may also consist of an impressed step at the edge of the aperture. The shape of the aperture may even be used as an adjusting means. In addition, an offset or deep-drawn edge of the aperture has the advantage that the handle device in said region can be arranged flush with the outer side of the door.

It is likewise conceivable for the handle part to be movable at least between a rest position and an operating position, the handle part, in particular, lying substantially flush with the outer side of the door in the rest position and protruding out of the outer side of the door into an operating position. It is therefore possible to configure the handle device to be substantially flush with the outside door. A handle device of this type has the advantages that it does not protrude out of the outer side during the operation of the vehicle and therefore wind noises, in particular at high speeds of the vehicle, can be reliably avoided. In addition, the risk of an accident, in particular for pedestrians or other people, can also be reduced, since no parts of the handle device protrude out of the outer side of the door in the manner of a projection. On account of this problem, for example, the side mirrors in motor vehicles are configured so as to be foldable and are then flexibly folded inward upon contact with a person. Furthermore, a handle part of a handle device arranged flush with the outside door can also be significantly less soiled than a handle part which protrudes out of the outer side of the door. A flush handle device therefore has substantial advantages.

In the case of the previously described flush handle device, provision can be made for the aperture in the door, in particular in a door panel, to be substantially closed by the handle shell. In this connection, the handle shell together with the handle mount can in particular hold the handle device in a form-fitting and/or frictional manner in the opening on the door panel. In this refinement of the invention, it is likewise possible to omit fastening the first and/or the second module directly to the door with additional fastening means.

One measure improving the invention can make provision for the first module to have a blocking unit which serves for locking the handle part. In this case, the blocking unit in particular can be actuated either manually or automatically via an actuating unit. It is likewise conceivable for the first module to have a locking cylinder which serves to manually unlock a security system, as a result of which the locking device can be operated by means of the handle part. All of the essential components of the handle device according to the invention can therefore be preassembled on the first module or the second module of the handle device, wherein the final installation consists only of connecting the two modules to the vehicle. After said final installation, the handle device merely has to be connected to the mechanical transmission elements, for example for the central locking or the locking device, or to the electric transmission elements, in the form of electric lines to the security system or to the motor vehicle electronics. The mechanical transmission elements may consist, for example, of a Bowden cable or a linkage which transmits the pivoting movement of the handle part or the acting tensile forces on the handle part to the locking device.

A spring element can also be preassembled on the first module, and therefore, after the final installation, the movable handle part can be subjected to the corresponding spring force. After connection of the two modules, said spring element therefore acts on the movable handle part. In this case, the spring force can be used in order to retract or extend the handle part.

The blocking unit which has already been mentioned above and which is arranged on the first module can be moved between a locking position and a release position, a movement of the handle part being permitted in the release position and a movement of the handle part being blocked in the locking position. Said blocking unit can therefore also serve as a crash interlock, since the blocking unit prevents unintentional opening of the door if, in particular, acceleration forces act on the handle part in the event of an accident of the vehicle. The blocking unit preferably always takes up the locking position thereof and only for the movement of the handle part from the rest position into the operating position is transferred into the release position required for this purpose. The handle part is therefore basically locked in the rest position by the blocking unit. For this purpose, the blocking unit can have a blocking element, as a result of which, in the locking position of the blocking unit, the handle part is held in a form-fitting manner and, in the release position of the blocking unit, the handle part is released so as to be movable. A part from the rest position thereof, the handle part itself can also have a second operating position in addition to a first operating position. In the first operating position, the handle part is extended or pivoted a little out of the rest of the handle device such that it is easily accessible for an operator. From there, said handle part can then be transferred into the second operating position by means of tensile force. In said second operating position, the handle part protrudes further out of the outer side of the door than in the first operating position of said handle part. The movement of the handle part from the first operating position into the second operating position can be used mechanically to actuate the locking device, in particular via the transmission element. The locking device can itself consist of a lock which can lock the door. In the second operating position, the locking device is opened, the operator being able to open the door by way of the handle part. Of course, instead of the abovementioned transmission element, it is conceivable for an electric component, in particular a switch, to be activated for the transfer of the handle part from the rest position thereof, optionally via the first operating position, into the second operating position, said switch subsequently correspondingly activating the locking device, as a result of which the lock can be opened and/or closed electromechanically.

Furthermore, provision may optionally be made for the actuating unit which serves to actuate the blocking unit to conceal the locking cylinder with respect to the outer side of the door. In the event of a manual actuation of the actuating unit, the latter at least partially releases the locking cylinder. Upon said actuation of the actuating unit, the handle part is released at the same time. It is likewise conceivable for the blocking unit additionally to serve as a mechanical drive for the handle part. In this case, the blocking unit not only releases the handle part but the latter can also be transferred from the rest position into the first operating position. The blocking element which has a first and a second end can serve for this purpose, the first end being arranged on the actuating unit and the second end interacting with the handle part. The blocking element itself can have a beveled step which mechanically interacts with a cam or projection on the handle part, wherein the required pivoting movement of the handle part from the rest position into the first operating position can be produced by the step of the blocking element pushing out the handle part on the projection.

Furthermore, provision may be made for the actuating unit to have a cover which serves as a contact surface. Said cover, in the unactuated state, can be arranged flush with the outer side of the door and, in particular, can conceal the locking cylinder. Therefore, the cover for the actuating unit carries out two functions at the same time, since said cover can firstly constitute protection for the locking cylinder and secondly can serve as an actuating surface. It has proven particularly advantageous if the cover is configured so as to be removable such that the locking cylinder is entirely released, even if the actuating unit otherwise conceals the locking cylinder. The removable cover can be configured so as to be slidable on the actuating unit, in particular on an actuating element, and can latch to the latter via latching and mating latching means. The cover is expediently pushed on only after arranging the first and second module on the door. The cover can therefore also serve to close off an open part of the handle shell, which part is not closed by the handle part in the rest position. Consequently, a flush handle device can be achieved even if a blocking unit is additionally present for locking the handle part.

The handle device can likewise additionally be provided with an electronic unit which, for example, constitutes a component of the security system. The electronic unit can also serve to realize illumination for the area laterally around the door of the vehicle. However, the electronic unit may also comprise a proximity sensor or an antenna or the like. The security system may itself be an access authorization system and/or a driving authorization system. Keyless access, for example via an ID transmitter, to the vehicle can therefore be realized by the electronic unit.

It should also be mentioned at this juncture that the handle part in the handle device according to the invention is transferred from the rest position thereof into the first and/or second operating position thereof purely manually. If the handle part changes mechanically between the rest position thereof and the operating position thereof, a corresponding spring element is present for the resetting of the handle part.

The invention also describes a method for installing a handle device which serves for operating a locking device of a vehicle. The handle device contains a first module which has the handle mount and which is arranged on the inner side of the door by means of the handle mount. Furthermore, the handle device has the second module which is arranged on an outer side of the door and contains a handle part, wherein the handle part is mounted movably with respect to the door in order to operate the handle device. Provision is made in this connection for the first and the second module to be preassembled, the second module being preassembled at least from a handle shell and a handle part, which is mounted movably on the handle shell, and subsequently, for the final installation, the two preassembled modules being fastened to the door. Said final installation is intended to implement the functioning capability of the handle device on the door. As has already been explained previously, only the electric and/or mechanical transmission elements are still to be connected to the handle device. The installation method is therefore distinguished by simple final installation on the door of the vehicle. All of the remaining installation steps can already be preassembled at the manufacturer of the handle device, wherein, in particular, installation steps carried out mechanically can be used.

Furthermore, provision can be made in the installation method for the first module to be constructed from the handle mount and a blocking unit, the blocking unit in particular having an actuating unit. The blocking unit can also be used not only for blocking the handle part but also for driving the handle part. Furthermore, a spring element and/or a locking cylinder can be preassembled on the handle mount of the first module, and, after the final installation, the spring element in particular interacts mechanically with the handle part and the locking cylinder serves to manually unlock a security system. Furthermore, the first module can be latched to the second module, wherein the door is arranged between the first and the second module. For said latching, latching elements, which interact with corresponding mating latching elements on the first module, can be provided on the second module. To secure the connection of the first and the second module, an additional fastening element in particular can be provided so that the two modules are not released from each other even in the event of severe shaking and other influences.

Furthermore, provision may optionally be made for a cover to be fastened to the handle part and/or for a further cover to be fastened to the actuating unit. As a rule, the arrangement of the cover on the handle part is undertaken during the preassembly of the second module, whereas the cover for the actuating unit is fastened to the door only after the first module has been connected to the second module. However, it is also conceivable for said further cover for the actuating unit also to be fastened during the preassembly process.

Figure 2:
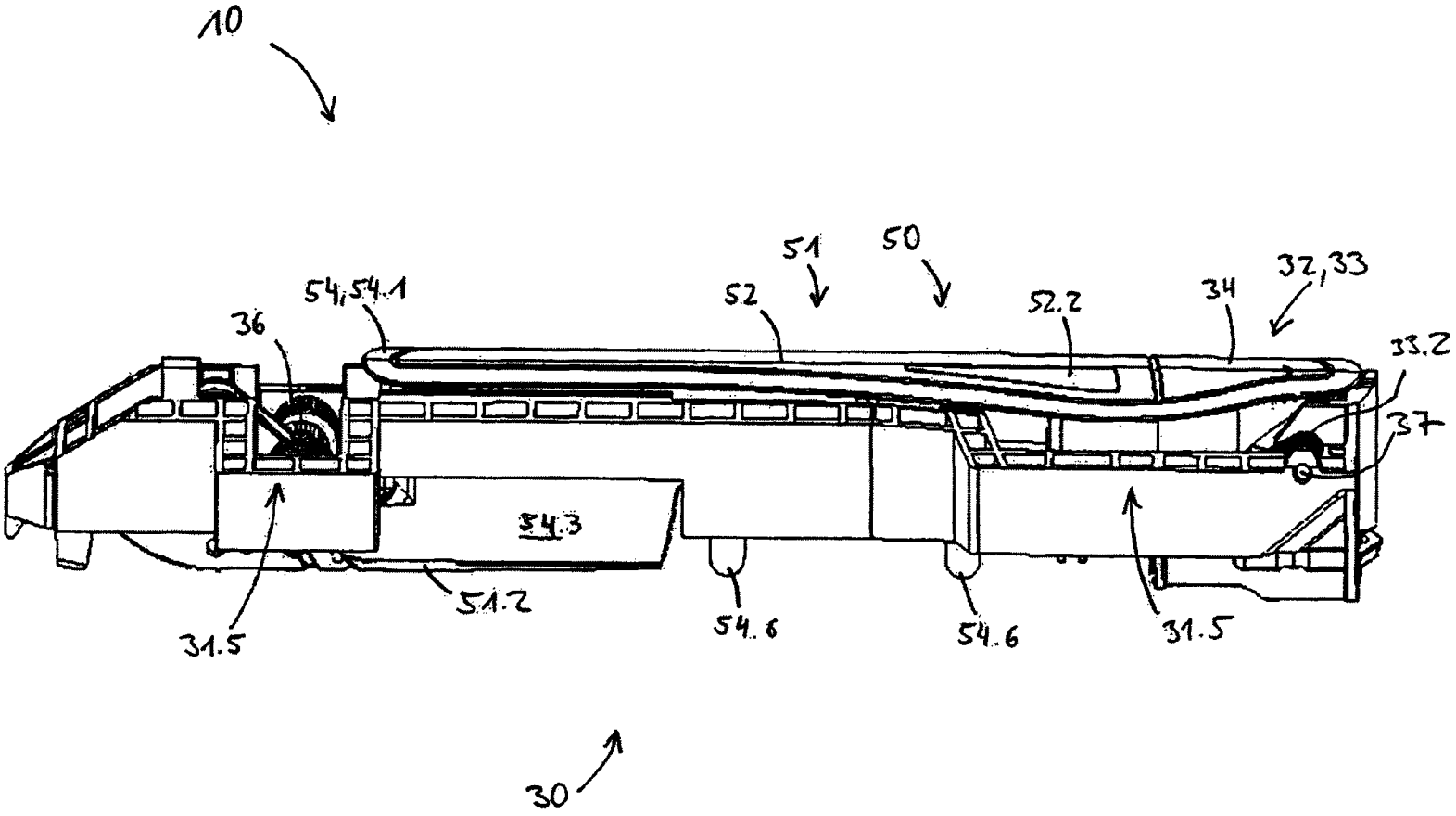
Figure 3A:
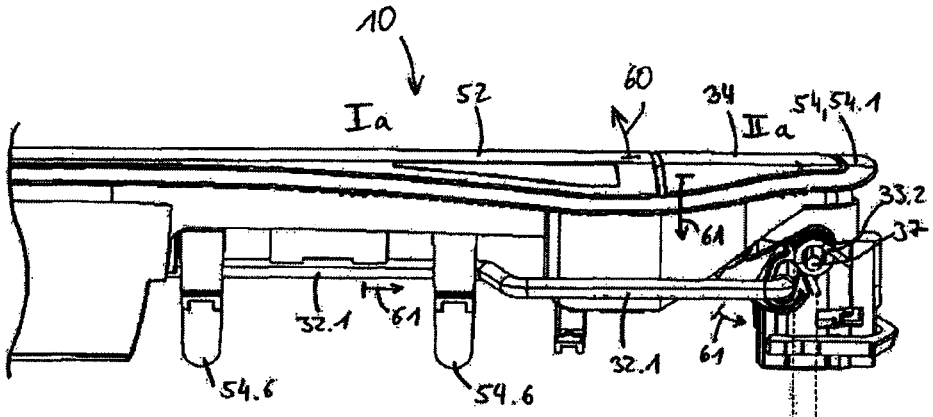
Figure 3B:
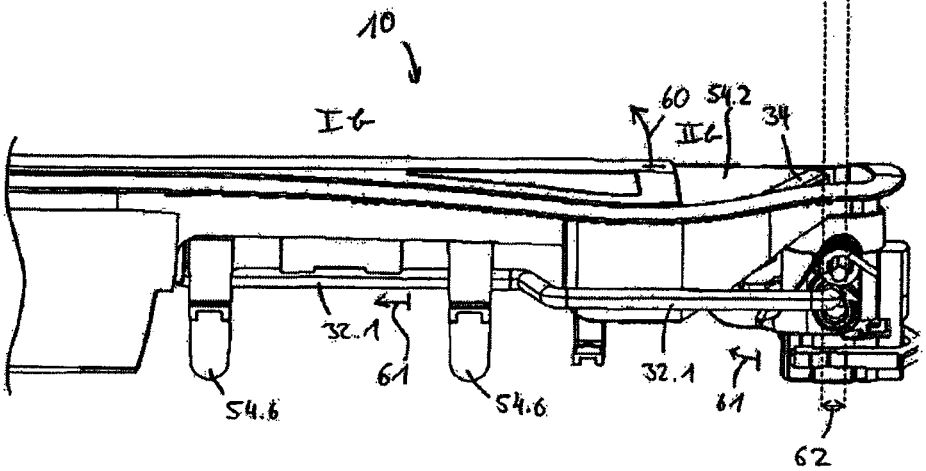
Figure 4A:
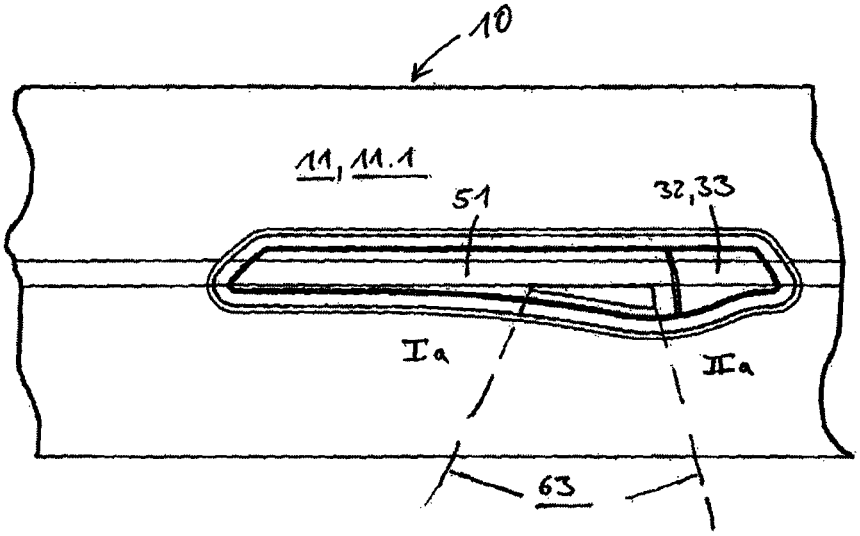
Figure 4C:
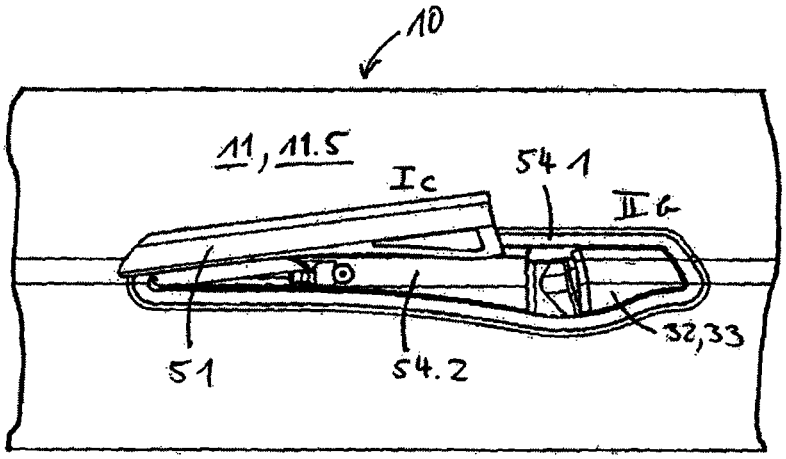
Figure 5:
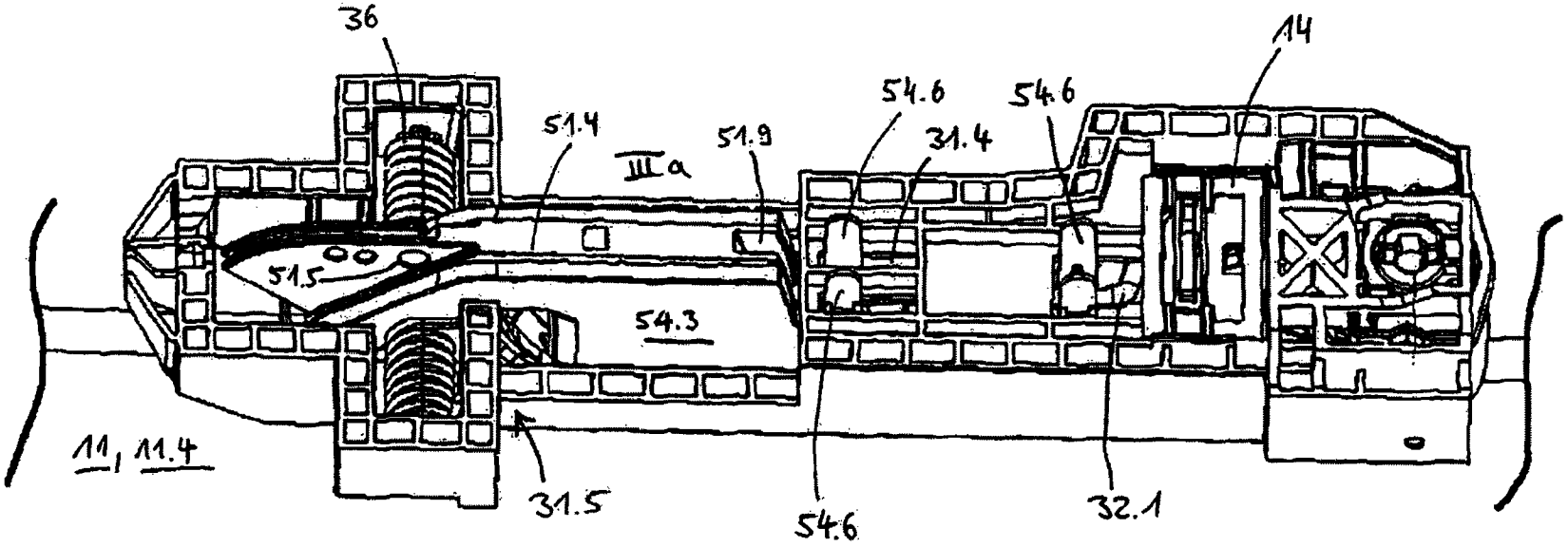
Figure 6:
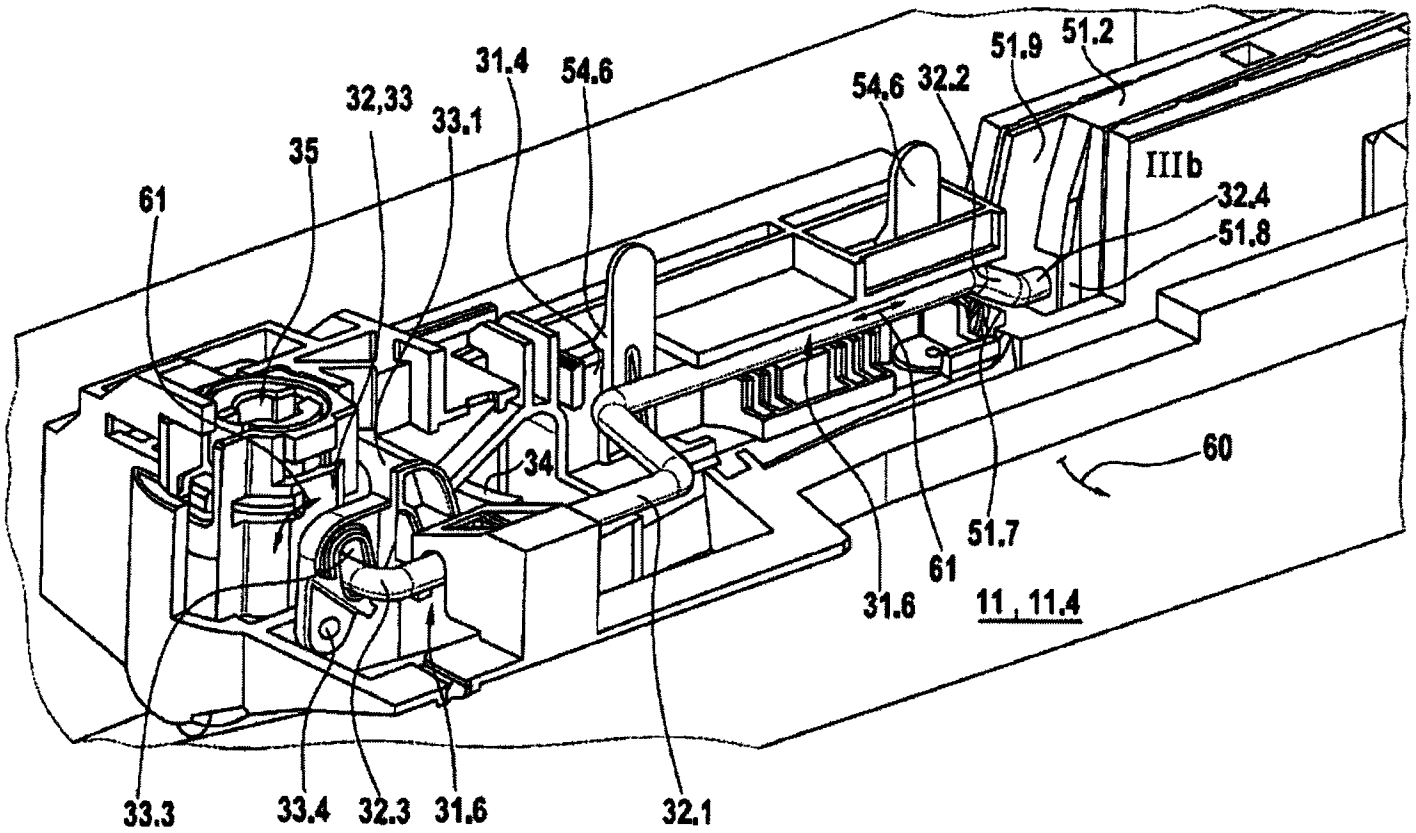

Further advantageous measures and features of the invention emerge from the description below and the depicted figures. The invention is illustrated in a number of exemplary embodiments in the figures, in which:

FIG. 1 shows an exploded illustration of the handle device according to the invention with a first and a second module, FIG. 2 shows a three-dimensional side view of the handle device according to the invention in a rest position of a handle part, FIG. 3*a* shows a comparable side view to FIG. 2, but in the rest position of the handle part and in the locking position of a blocking unit, FIG. 3*b* shows a comparable handle device from FIG. 3*a*, but in a first operating position of the handle part and in a release position of the blocking unit, FIG. 4*a* shows a top view of a handle device according to the invention as a flush outside door handle in the rest position of the handle part, FIG. 4*b* shows a top view of a comparable handle device from FIG. 4*a* in a second operating position of the handle part, FIG. 5 shows a three-dimensional view of the rear side of the handle device according to the invention in the locked state, and FIG. 6 shows a three-dimensional sectional view of a further handle device according to the invention with a detailed illustration of a blocking unit with an actuating unit.

FIG. 1 illustrates an exploded illustration of the handle device 10 according to the invention, wherein said handle device 10 has a first module 30 and a second module 50. Said handle device 10 is fastened to a door 11, for which purpose an opening 11.2 is provided in a door panel 11.1 in a vehicle. The fastening of the handle device 10 to the door 11 is also referred to as the final installation, which is realized by the first module 30 being arranged on an inner side 11.4 of the door 11 and a second module 50 being arranged on an outer side 11.5 of the door 11. The two modules 30, 50 can be connected to each other in a form-fitting and/or frictional manner via latching and mating latching elements. In the exemplary embodiment of FIG. 1, the latching elements 54.6 are fastened to a handle shell 54 which belongs to the second module 50. Furthermore, the corresponding mating latching elements 31.4 are arranged on a handle mount 31 which is part of the first module 30. The latching elements 54.6 consist of barb-shaped or spring-mounted projections which interact, in particular in a form-fitting manner, with the mating latching elements 31.4, wherein the mating latching elements 31.4 consist of apertures. The interaction of the latching elements 54.6 with the mating latching elements 31.4 can readily be seen in FIGS. 5 and 6. In order also to hold the handle device 10 securely on the door 11 against vibrations and shaking or other external influences, a fastening element 14 which connects the two modules 30, 50 to each other can additionally be provided. Said fastening element 14 is illustrated in FIG. 1 as a securing plate which connects the two modules 30, 50 to each other in a form-fitting manner. In FIG. 5, the fastening element 14 can be seen in the final installation state on the handle device 10. Removal of the handle device 10 is therefore possible only if the access to the inner side 11.4 of the door 11 is released. For this purpose, the fastening element 14 has to be first of all removed in order then to release the connection between the latching elements 54.6 and the mating latching elements 31.4.

As is furthermore apparent in FIG. 1, the first module 30 has a blocking unit 32 which serves to lock the handle part 51. The blocking unit 32 is itself actuable via an actuating unit 33. The actuating unit 33 contains an actuating element 33.1 which is configured, for example, as an articulated rocker. Furthermore, the actuating unit 33 has a spring element 33.2, as a result of which the actuating element 33.1 can be transferred automatically into a locking position IIa. So that the actuating element 33.1 is arranged rotatably or pivotably on the handle mount 31, two bearing pins 37 which interact with corresponding apertures 33.4 in the actuating element 33.1 are provided. Furthermore, the actuating unit 33 has a receptacle 33.3 which serves for a blocking element 32.1 of the blocking unit 32. In order to permit simple and comfortable actuation of the actuating unit 33, the latter is equipped with a cover 34 which is arranged, in particular in a reversibly releasable manner, on the actuating element 33.1 by means of a holding means. The actuating unit 33 with the actuating element 33.1 thereof is illustrated in more detail in FIG. 6. In addition, the functioning of the actuating unit 33 is revealed in more detail from FIGS. 3*a* and 3*b*.

Furthermore, it can be seen from FIG. 1 that the first module 30 has a locking cylinder 35 in addition to the handle mount 31. Said locking cylinder 35 is located in a locking cylinder receptacle 31.1 on the handle mount 31. The locking cylinder 35 is held in a form-fitting manner in said locking cylinder receptacle 31.1 via a fastening element 13, which is configured as a securing plate. Furthermore, the first module 30 has a spring element 36 for a handle part 51 (second module 50). Said spring element 36 is arranged securely on the handle mount 31 by means of the mount 31.7. The mount 31.7 consists of two projecting pins which engage in a form-fitting manner in the spring element 36. In FIG. 1, the spring element 36 serves as a resetting element for the handle part 51 such that the latter can be transferred automatically into the rest position Ia thereof. For this purpose, the spring element 36 has, between the two spiral regions thereof, a drawn-out web region which interacts mechanically with the handle part 51, in particular a bearing arm 51.4. In the installed state, the spring element 36 therefore exerts a permanent resetting force on the handle part 51 in an operating position Ib, c of the handle part 51.

The second module 50 of the handle device 10 contains the handle shell 54 and the handle part 51 mounted thereon. The handle part 51 can itself consist of a plurality of individual parts, if said handle part is intended to be used for receiving an electronic unit 53. For this purpose, a cavity 51.1, in which the electronic unit 53 can be embedded, can be provided in the handle part 51. In order to close the cavity 51.1 and to protect the electronic unit 53 against environmental influences, it is possible to provide a cover 52 which can be arranged in particular via latching means 52.3 with mating latching means 51.6 on the handle part 51. The cover 52 can additionally be secured on the handle part 51 by means of a holding means 56. Said holding means 56 can have a screw. In the present exemplary embodiment from FIG. 1, the cover has a covering 52.2 in an opening 52.1, the covering 52.2 serving as an antenna for the electronic unit 53. In this case, the covering 52.2 is expediently configured so as to be electrically conductive. The electronic unit 53 can be connected to a security system or to the rest of the vehicle electronics, wherein an electric line is guided through the handle part 51, in particular a bearing arm 51.4, into the interior of the door. The line of the electronic unit 53 can be electrically connected there to the security system or the rest of the vehicle electronics by means of a plug-in contact. The electronic unit 53 can belong to an active or passive access system and/or to a driving authorization system, in particular an immobilizer. Furthermore, the electronic unit 53 can also have a capacitive sensor or a proximity sensor or the like. It is also conceivable for the electronic unit 53 to be provided with a light source which serves to realize illumination for the surrounding area by means of the handle device 10. For this purpose, the covering 52.2 in the cover 52 of the handle part 51 is configured to be light-permeable.

In order to arrange the handle part 51 so as to be mountable on the handle shell 54, an aperture 51.3 is provided in the bearing arm 51.4, said aperture together with a bearing pin 55 forming a rotary bearing with the handle shell 54. A corresponding aperture is likewise provided in the bearing arm 54.3 of the handle shell 54 for the form-fitting receiving of the bearing pin 55. In contrast to the handle part 51, the handle shell 54 has two parallel bearing arms 54.3, between which the bearing arm 51.4 of the handle part 51 is guided. Of course, a complementary arrangement of the respective bearing arms is also conceivable. In order for the handle part 51 to have a laterally stable guide, said handle part is equipped with an articulated guide 51.2 which mechanically interacts with the handle shell 54. The handle shell 54 itself has an opening 52.1 into which the handle part 51 comes entirely or partially to lie when said handle part is in the rest position Ia. Furthermore, an aperture 54.4 for the actuating unit 33, in particular the actuating element 33.1, is provided in the handle shell 54. The handle shell 54 likewise has a further aperture 54.5 for the locking cylinder 35. However, it is not necessary for each handle device 10 according to the invention to be equipped with a locking cylinder 35, since, customarily, in the case of an existing access authorization system, only the driver's side or passenger's side is provided with a mechanical locking cylinder 35.

In the same manner as the first module 30, the second module 50 can be preassembled at the manufacturer of the handle device 10 such that only the two modules 30, 50 still have to be joined together for the final installation on the door 11. Subsequently, a transmission element merely has to be connected from the movably mounted handle part 51 to a locking device 12 in the door 11. A corresponding locking device 12 is indicated schematically in FIG. 1 as a lock. A door 11 is customarily opened by pulling on the movable handle part 51, as a result of which the handle part 51 is transferred into an operating position Ic, and said movement by means of the transmission element is used in order to open the locking device 12 such that the door 11 is no longer mechanically locked. By application of a further tensile force on the handle part 51, the door 11 can then be pivoted open.

FIG. 2 illustrates a further exemplary embodiment of a handle device 10 in a three-dimensional side view. The door panel 11.1 has not been depicted here so as therefore to make the handle device 10 completely visible. Said handle device 10 differs from the handle device 10 from FIG. 1 by a locking cylinder 35 not being used. Furthermore, the present handle device 10 is illustrated in an installed state, wherein the handle part 52 is in a rest position Ia and the blocking unit 32 with the actuating unit 33 thereof is arranged in the locking position IIa. In the present case, the cover 34 of the actuating unit 33 and the cover 52 of the handle part 51 are arranged flush with an edge 54.1 of the handle shell 54. However, the present invention is not restricted to this exemplary embodiment. Of course, the handle part 51, in the rest position Ia thereof, can also protrude out of the handle shell 54. The same also applies for the blocking unit 32 with the actuating unit 33 thereof. In order to obtain a lightweight and nevertheless extremely stable handle device 10, the handle mount 31 has a honeycomb-shaped construction 31.5. In the exemplary embodiment from FIG. 2—as in FIG. 1—the handle part 51 is transferred mechanically by means of the spring element 36 into the rest position Ia. It is also clear from said side view in FIG. 2 that the lateral bearing arms 54.3 of the handle shell 54 surround the articulated guide 51.2 and laterally stabilize the latter during a rotational movement of the handle part 51. It is likewise possible to see the latching elements 54.6 which protrude out of the handle mount 31 at the bottom in order to be able to be actuated, optionally by hand, during removal of the handle device 10. For this purpose, the latching elements 54.6, which each lie opposite one another in parallel (also see FIG. 5), merely have to be compressed, with the handle shell 54 being pressed out of the door panel 11.1 to the outside out of the handle mount 31 at the same time. If a fastening element 14 is also used, the latter should likewise be removed beforehand. Subsequently, the handle device 10 splits up during removal into the first module 30 and the second module 50. The latching elements 54.6 lying opposite one another are illustrated in more detail in FIG. 5.

The principle of a flush handle device 10 can be seen in both FIGS. 4*a* and 4*b*. The handle device 10 according to the invention is illustrated in the rest position Ia of the handle part 51 and in the locking position IIa of the blocking unit 32 in FIG. 4*a*. Said handle device 10 is arranged substantially flush with the outer side 11.5 of the door 11. It is therefore clear that a handle device 10 of this type generates no or only a little wind resistance, in particular when a vehicle is operating at high speeds. Consequently, wind noises can therefore be effectively avoided. The handle part 51 cannot be soiled either, since the actual actuating surfaces are directed toward the inner side 11.4. Consequently, the actuating surface of the handle part 51 can scarcely be soiled either, since it is not in direct contact with the environment. As has also been mentioned at the beginning, even the risk of an accident involving a person can be reduced, since the handle device 10 itself does not provide a contact surface for a person.

In the exemplary embodiment from FIG. 4*a*, the electronic unit 53 in the handle part 51 has a lighting means which generates a light level 63 through the window 52.2 in the opening 52.1 in the handle part 51. The lighting means can be controlled, for example, via a proximity sensor or using a signal from an ID transmitter. For example, the lighting means emits the light level 63 as soon as it is dark and an ID transmitter is activated outside the vehicle in order to initiate access to the vehicle. The lighting means can also be switched on only if the ID transmitter has been correctly identified. The switching-on operation can therefore be coupled to the unlocking operation of an access authorization system.

In FIG. 4*b*, the flush handle device 10 is illustrated in operation. In this case, the actuating unit 33 has been actuated in order to transfer the blocking unit 32 from the locking position IIa thereof into the release position IIb. In said release position IIb, the handle part 51 is no longer secured in a form-fitting manner by the blocking unit 32. At the same time, actuation of the actuating unit 32 can be used in order to transfer the handle part 51 from the rest position Ia thereof into a first operating position Ib. In said first operating position Ib, the handle part 51 can then be grasped for further actuation by the user. By means of the transfer of the handle part 51 from the first operating position Ib thereof into the second operating position Ic thereof, the corresponding transmission element can transmit the tensile force applied to the handle part 51 to the locking device 12 in order to open the latter.

At this juncture, it should be mentioned that the actuating unit 33 can also be used only to transfer the handle part 51 from the rest position Ia thereof into the first operating position Ib thereof. In this case, the actuating unit 33 therefore constitutes a mechanical drive for the handle part 51. A handle device 10, in which the actuating unit 33 does not exert any mechanical effect on the handle part 51, is also conceivable. A corresponding cover 34 of the actuating unit 33 merely has to be pressed into the opening 11.2 in order to be able to reach with the finger behind the handle part 51. In such an alternative, the handle part 51 also has only one rest position Ia and one operating position Ib or Ic.

FIGS. 3*a* and 3*b* show the functioning of the blocking unit 32 and of the actuating unit 33 in more detail. The directions of movement of the handle part 51 and of the actuating unit 33 are also illustrated in these figures by the arrows 60 and 61. In FIG. 3*a*, the handle part 51 is in the rest position Ia and the actuating unit 33, which serves to actuate the blocking unit 32, is in the locking position IIa. The locking device 12 of the door 11 is brought about by a movement of the handle part 51 in the direction of the arrow 60. Since, however, the handle device 10 according to the invention from FIGS. 3*a* and 3*b* is provided with a blocking unit 32, the latter first of all has to release the handle part 51. For this purpose, the actuating unit 33 has to be pivoted in the direction of the arrow 61, said actuating unit entering the opening 54.2 in the handle shell 54. In principle, the blocking unit 32 is pressed with the actuating unit 33 thereof into the locking position IIa by the spring element 33.2. Said spring element 33.2 acts between the handle mount 31 and the actuating element 33.1 and is configured as a torsion spring. The actuating unit 33 now has to be pressed in the direction of the arrow 61 counter to the spring force of the spring element 33.2. By this means, the actuating element 33.1 is pivoted about an axis of rotation, wherein the corresponding axis of rotation lies on the longitudinal axis of the two bearing pins 37. By means of the pivoting movement of the actuating element 33.1, the receptacle 33.3 is inevitably rotated at the same time, wherein said rotational movement is converted into a longitudinal movement of a blocking element 32.1 of the blocking unit 32. For this purpose, the receptacle 33.3 has an elongated hole in which the first end 32.3 of the blocking element 32.1 engages. Since the blocking element 32.1 is arranged so as to be movable essentially in a (linear) guide 31.6 in the handle mount 31, the blocking element 32.1 follows the rotational movement of the actuating element 33.1 with a longitudinal movement (see arrow 61 on blocking element 32.1). In FIG. 3*b*, the longitudinal stroke produced by the blocking element 32.1 is shown as a distance 62 which results from the rotational movement of the actuating element 33.1. It can also be seen how the first end 32.1 has been displaced in the elongated hole in the receptacle 33.3. In FIG. 3*b*, the blocking unit 32 is now in the release position IIb thereof, in which the handle part 51 is freely movable. The handle part 52 can now be actuated in the direction of the arrow 60 in order to open the locking device 12 and therefore also the door 11. It should be mentioned with regard to the exemplary embodiment from FIGS. 3*a* and 3*b* that a purely mechanical handle device 10 is involved here. The rotational movement of the actuating element 33.1 can also be replaced by a comparable pivoting movement in order to displace the blocking element 32.1. The interaction of the blocking element 32.1 with the handle part 51 is illustrated in detail in FIG. 6. It is likewise also shown in FIG. 6 how the blocking unit 32 can be used at the same time in order to move or drive the handle part 51 between the positions thereof.

FIG. 6 illustrates a further exemplary embodiment of the handle device 10 according to the invention in a three-dimensional sectional view. In this case, the view in particular of the blocking unit 32 with the actuating unit 33 is opened up. Actuation of the blocking unit 32 via the actuating unit 33 likewise leads to a pivoting movement of the actuating element 33.1, as a result of which a longitudinal movement of the blocking element 32.1 is produced. The blocking element 32.1 is of substantially rod-like design and has a first end 32.3 and a second end 32.4. The first end 32.3 is operatively connected to the actuating element 33.1. By contrast, the second end 32.4 is operatively connected to the handle part 51. In the illustrated position IIIb of the blocking element 32.1, the handle part 51 is released, since the second end 32.4 no longer engages in a form-fitting manner in an aperture 51.8 in the handle part 51. The handle part 51 can therefore be rotated in the handle shell 54. However, the blocking unit 32 also serves as a drive for the handle part 51 by the blocking unit 32 transferring or pressing the handle part 51 from the rest position Ia into the first operating position Ib counter to the spring force of the spring element 36. For this purpose, the blocking element 32.1 has a bend or step 32.2 which interacts with a projection 51.7 on the handle part 51. If the blocking element 32.1 is now displaced longitudinally (see arrow 61), the blocking element 32.1 presses with the step 32.2 onto the projection 51.7 of the handle part 51, as a result of which the handle part 51 is extended out of the rest position Ia during a further longitudinal movement of the blocking element 32.1. So that the handle part 51 extends and the blocking element 32.1 does not have to avoid the projection 51.7, the guide 31.6 is provided on the handle mount 31. Said guide 31.6 supports the blocking element 32.1 in particular in the region of the step 32.2. The blocking element 32.1 can therefore only be displaced longitudinally in said region, since the guide 31.6 does not permit a different movement. The blocking element 32.1 is also securely mounted by the guide 31.6 in the region of the first end 32.3. In order also to ensure optimum mounting and guiding of the handle part 51 in the operating position Ib and Ic, the bearing arm 51.4 additionally has a guide channel 51.9 for the second end 32.4 of the blocking element 32.1, along which the latter slides. The blocking element 32.1 is therefore always securely guided on the handle part 51, and therefore distortion or locking of the handle part 51, in particular in an operating position Ib or Ic, is avoided.

In the locking position IIa (not illustrated in FIG. 6), the second end 32.4 of the blocking element 32.1 engages in a form-fitting manner in the aperture 51.8 in the handle part 51. The aperture 51.8 can also be configured as a bore. In this case, the blocking element 32.1 is in a first position IIIa and blocks the handle part 51 in a form-fitting manner in the handle shell 54. Therefore, even at high acceleration forces, which act on the handle device 10, for example, in the event of an accident, unintentional release of the locking device 12 cannot occur. Therefore, a further crash interlock can be dispensed with in the device 10 according to the invention.

It is also clearly visible in FIG. 6 how the latching elements 54.6 of the handle shell 54 hook in a form-fitting manner behind the mating latching elements 31.4 of the handle mount 31, wherein the mating latching elements 31.4 are configured as longitudinal openings.

FIG. 5 illustrates a three-dimensional view of a further exemplary embodiment of the device 10 according to the invention in the installed state. In this case, the abovementioned guide 51.9 on the bearing arm 51.4 of the handle part 51 for the blocking element 32.1 is also visible. Said guide 51.9 consists essentially of a curved slot which is provided on the edge of the bearing arm 51.4. The aperture 51.8 for locking the handle part 52 is arranged at the end of the guide 51.9. The receptacle for the transmission element 51.5 in the bearing arm 51.4 can also be seen in FIG. 5, wherein the present receptacle 51.5 is suitable for a Bowden cable. In order to thread in the Bowden cable, a longitudinal slot is provided on one side in the bearing arm 51.4 which ends in the receptacle 51.5. A curved channel for the Bowden cable is likewise arranged in the bearing arm 51.4 in order as far as possible to prevent bending of the Bowden cable. As can readily be seen from the whole of FIG. 5, the handle mount 51 has a continuously honeycomb-shaped construction 31.5. The fastening element 14 in the region of the shell receptacle 31.2 is likewise clearly illustrated. Said fastening element 14 consists of a punched plate, which secures the two modules 30, 50 to each other in a form-fitting and frictional manner. In addition, said securing plate 14 has stamped regions which protrude resiliently from the rest of the securing plate 14. A securing lug is also arranged in the punched region of the securing plate, the securing lug interacting in a form-fitting manner with the handle mount 31 such that the securing plate 14 can only be fitted in one position. The securing plate is likewise provided with a projection in order easily to be able to remove said securing plate again during final installation. The installed handle shell 54 with the handle part 51 mounted therein can be seen in the region of the handle part receptacle 31.3 (see FIG. 1).

Finally, it should be mentioned that the above-described exemplary embodiments can be combined arbitrarily with one another, and therefore the features which have been disclosed with respect to one exemplary embodiment can also be present in a different exemplary embodiment.

LIST OF DESIGNATIONS

10 Handle device
11 Door
11.1 Door panel
11.2 Opening in door panel
11.3 Step
11.4 Inner side
11.5 Outer side
12 Locking device (lock)
13 Fastening element for 12 (securing plate)
14 Fastening element for 30; 50 (securing plate)
15
30 First module
31 Handle mount
31.1 Locking cylinder receptacle
31.2 Shell receptacle
31.3 Handle part receptacle

31.4 Mating latching elements
31.5 Honeycomb-shaped construction
31.6 Guide for 32, 32.1
31.7 Mount for 36
32 Blocking unit
32.1 Blocking element (rod)
32.2 Step in 32.1
32.3 First end
32.4 Second end
33 Actuating unit for blocking unit
33.1 Actuating element (CC articulated rocker)
33.2 Spring element for actuating part
33.3 Receptacle for 32, 32.3
33.4 Aperture (rotary joint)
34 Cover for 33
35 Locking cylinder
36 Spring element for handle part
37 Bearing pin for 33
50 Second module
51 Handle part
51.1 Cavity for 53
51.2 Articulated guide
51.3 Aperture (rotary joint)
51.4 Bearing arm
51.5 Receptacle for transmission element (Bowden cable or the like)
51.6 Mating latching means for 52
51.7 Projection for 32
51.8 Aperture/bore for 32, 32.4
51.9 Guide for 32, 32.1
52 Cover for 51
52.1 Opening
52.2 Covering/window
53 Electronic unit in 51
54 Handle shell
54.1 Edge
54.2 Opening
54.3 Bearing arm
54.4 Aperture for 33
54.5 Aperture for 12
54.6 Latching means
55 Bearing pin for 51
56 Holding means (screw) for 52
60 Arrow for 51
61 Arrow for 53
62 Distance
63 Light level
Handle part 52:
Ia Rest position flush with the door panel
Ib First operating position for actuation
Ic Second operating position (end position)
Blocking unit 32:
IIa Locking position (handle part blocked)
IIb Release position
Blocking element 32.1:
IIIa First position
IIIb Second position

The invention claimed is:

1. A handle device for a locking device for a movable door on a vehicle, said handle device comprising:

a handle part mounted movably with respect to a door of the vehicle, said handle part being movable between a rest position-and an operating position, wherein, in the rest position, the handle part is arranged flush with an outer side of the door and, in the operating position, the handle part protrudes from the outer side of the door, wherein, in the operating position, the handle part can be operated in order to open the door;

a blocking unit locking the handle part in the rest position; and an actuating unit operatively connected to the blocking unit and moving said blocking unit between a locking position and a release position, wherein upon moving said blocking unit from said locking position to said release position, said actuating unit moves the handle part from the rest position toward the operating position, wherein the blocking unit is biased into the locking position and is transferred into the release position only for the movement of the handle art from the rest position into the operating position.

2. The handle device as claimed in claim 1, in which the actuating unit an actuating element which interacts mechanically with the handle part and, upon actuation, transfers the handle part into the operating position.

3. The handle device as claimed in claim 1, in which the handle part includes a spring urging the handle part into the rest position, the actuating element acting counter to the spring.

4. The handle device as claimed in claim 1, in which, in the release position of the blocking unit, a movement of the handle part is permitted and a movement of the handle part is blocked in the locking position, the blocking unit preventing unintentional opening of the door if acceleration forces act on the handle part in the event of an accident of the vehicle.

5. The handle device as claimed in claim 1, in which the blocking unit has a blocking element, and in the locking position of the blocking unit, the handle part is held in a form-fitting manner and, in the release position of the blocking unit, the handle part is released so as to be movable.

6. The handle device as claimed in claim 5, in which the actuating unit conceals a locking cylinder with respect to the outer side of the door, the actuating unit at least partially releasing the locking cylinder—in the event of manual actuation of the handle part.

7. The handle device as claimed in claim 6, in which the actuating unit has a cover which, in an unactuated state of the actuating unit, the cover is arranged flush with the outer side of the door and conceals the locking cylinder, the cover being configured so as to be removable.

8. The handle device as claimed in claim 1, in which an opening for the handle device is provided in the door, said opening being substantially closed by a handle shell, and the handle shell together with a handle mount holding the handle device in the opening in at least one of a form-fitting manner and a frictional manner.

9. The handle device as claimed in claim 1, wherein upon actuation of the actuating unit, an electric signal is generated to switch on at least one of a security system and convenience electronics.

* * * * *